US005181332A

United States Patent [19]

Uren et al.

[11] Patent Number: 5,181,332

[45] Date of Patent: Jan. 26, 1993

[54] WATER SKI BOOT AND BINDING

[76] Inventors: Dean P. Uren, 31654 N.E. 106th, Carnation, Wash. 98014; James D. Anderson, 10312 164th Ave. N.E., Redmond, Wash. 98052

[21] Appl. No.: 794,801

[22] Filed: Oct. 28, 1991

Related U.S. Application Data

[63] Continuation of Ser. No. 498,378, Mar. 26, 1990, abandoned.

[51] Int. Cl.[5] ..... A43B 5/04; A63C 5/00

[52] U.S. Cl. ..... 36/114; 36/117; 441/68

[58] Field of Search ..... 36/114, 117, 121, 119; 491/68, 70, 73, 76; 280/607

[56] References Cited

U.S. PATENT DOCUMENTS

| | | | |
|---|---|---|---|
| 4,162,089 | 7/1979 | Alber | 36/117 |
| 4,227,274 | 10/1980 | Richardson | 441/68 |
| 4,296,511 | 10/1981 | Wright | 441/68 |
| 4,387,517 | 6/1983 | Annovi | 36/117 |
| 4,565,017 | 1/1986 | Ottieri | 36/117 |
| 4,601,118 | 7/1986 | Zanatta | 36/121 |
| 4,770,648 | 9/1988 | Gillis | 441/70 |
| 4,793,077 | 12/1988 | Walkhoff et al. | 36/117 |
| 4,795,386 | 1/1989 | LaPoint | 441/68 |
| 4,839,972 | 6/1989 | Pack et al. | 36/117 |
| 4,891,027 | 1/1990 | Plunkett | 441/68 |
| 4,979,760 | 12/1990 | Derrah | 36/54 |

FOREIGN PATENT DOCUMENTS

| | | | |
|---|---|---|---|
| 3447012 | 7/1985 | Fed. Rep. of Germany | 36/117 |
| 2570936 | 4/1986 | France | 36/117 |
| 2617380 | 1/1989 | France | 36/117 |

*Primary Examiner*—Steven N. Meyers
*Attorney, Agent, or Firm*—Christopher Duffy

[57] ABSTRACT

In the illustrated embodiments, the boot (22) has a sole plate (24) and a monolithic (54) shell of substantially rigid plastic material upstanding thereon. The shell forms an open top shoe structure (26) in which the user can insert the base of his foot, while he at the same time engages the metatarsal portion of his foot in a "holster" formed under an arched cowl (32) at the forward end of the shell. Meanwhile, at the back of the shell, there is a rear wall (36) that upstands to a level above the ankle joint of the user's foot, to form a strongback for the achilles tendon of his foot. The strongback (36) is accompanied by a part annular cuff (38) which is adapted to be removably secured about the user's lower leg above the ankle joint therein, and is supported on the shell at the top opening (28) thereof, so as to have no more than a limited capability to flex in relation to the shell laterally thereof. The cuff (38) is pivotally mounted on the shell to assume a normally upright position adjacent the strongback (36) when the user's leg is relaxed and straightened at the knee and is relesably detained in such position by the strongback. However, the upper cuff and the holster are spaced apart from one another by a gap (88) across the instep of the user's foot when the upper cuff (38) is releaseably detained in the normally upright position thereof; and there is an opening in the gap and a recess (114) in one of the strongback and pivot in conjunction with the user's lower leg, relative to the shoe structure, to any one of the positions to which the user may choose to pivot his lower leg for water skiing, including the low angle position it will assume when he squats or crouches for startup.

69 Claims, 4 Drawing Sheets

232
190
188
140'
1 2 3 4
172
198
124
212
210
154
178
220
174
146
12
156
166
230
164
218
22
228
162
158
124
222
226
176
160

12
154
208
180
10
146
188
158
162
170
224
214

204
168
216
172
124
160
10
212

210
164
156
228
200
202
230
124

184
154
188
192
180
194
204
196
182
202
198
124
186
206
158

WATER SKI BOOT AND BINDING

This application is a continuation of U.S. Ser. No. 498,378 filed Mar. 26, 1990, now abandoned.

TECHNICAL FIELD

This invention relates to the art of tow boat skiing, i.e., water skiing, and in particular, to a boot and binding with which a user can mount his foot on a water ski or the like for the skiing operation.

BACKGROUND ART

In water skiing, the user mounts a pair of skis, and is pulled by a boat at the end of a tow line, generally at high speed so that he can execute various maneuvers on the water with his skis. To pull him in this way, however, the tow boat must first raise him out of the water, or away from a floating object such as a dock, and then progressively accelerate him to the speeds at which he can execute the desired maneuvers. Meanwhile, the user may find it necessary to squat or crouch on his skis until the tow boat has given him sufficient forward momentum to enable him to straighten his legs, lean back on the skis, and stand fully erect in relation to them. Moreover, as he proceeds into open water and executes loops and turns on the same, the skier may find it necessary to once again bend one or both legs at the knees to enable him to keep his balance while he makes the turns; and in all events, as the tow boat comes to a halt, he may find it necessary to resume the crouched position he had before, at startup, because only in that position will he have sufficient stability to remain on the skis as the boat comes to a halt.

In the past, whether he was standing erect or with one or both legs bent at the knees, the user had little or nothing to assist his ankles in keeping his body erect and in maintaining his stability on the skis. In fact, his ankles were wholly unsupported, either by means on the skis themselves, or by means on his feet, such as some kind of boot which could afford lateral support for his ankles. Until the present invention, only so-called "bindings" were provided for mounting the skis, and these were essentially rubberized wraps with which he could "strap" his feet to the tops of the skis, in much the same manner as one would strap down an article on a sled, or to the top of a car. They made no provision for the "super-structure" of his feet, that is, the ankles which interconnect the feet with the lower legs. These were left to freestand above his feet, devoid of any support, fore or aft or to the sides of his legs. Meanwhile, in crouching, or in raising himself from a crouch, or in making turns with the boat, his ankles were subjected to considerable stress, and were subject to undergoing inversion and eversion, upon either of which he might pitch to one side or the other, and into the water, because he could no longer keep himself erect.

DISCLOSURE OF THE INVENTION

The present invention fills this void by providing high top boots for mounting on his feet, to lend support to his ankles when he skis, including support for them to the sides of and fore and aft of his legs. The boots may be mounted on his feet either before or when he mounts the skis themselves, and when the boots are in use during the skiing operation, the tops of them provide the full range of pivotal action through which the user may choose to put his lower legs, including the low angle position needed when he squats or crouches on the skis for startup or wind down of the operation. The tops of the boots may also provide a limited degree of flexibility on the part of the user's ankles, relatively laterally of the skis, and moreover, this degree of flexibility may be adjustable to suit the user's whim. In addition, the boots may also be adjustable to accommodate to varying leg lengths from one user to another.

Furthermore, the tops of the boots may be adapted so that they not only are capable of pivoting in conjunction with the user's lower legs, but in addition, are yieldably biased to resume normally upright positions corresponding to those of the user's lower legs when he relaxes his legs and straightens them at the knees. In fact, the tops of the boots may be yieldably biased to resume normally upright positions in which they simulate the ankles themselves, by aligning themselves with strongbacks that are disposed in the bottoms of the boots behind the achilles tendons of the user's feet to simulate the function of the tendons.

Additionally, the boots may be constructed as monoliths, for example, from moldable plastic material; and they may have insulative liners therein, which are removable if desired, such as where the liners are sock-like for wearing outside of the boots, but are insertable and removable into and from the boots with the user's feet at the time of use. Meanwhile, the boots themselves may be open-toed for ease in inserting the feet, including when they have such sock-like liners thereon. In this way, moreover, the water itself may add to the insulative effect of the liners, as it flushes through the toes of the boots during the skiing operation.

In addition to providing such boots for the user's ankles, the invention also provides a releasable snow ski-type binding for the skis themselves, with which the user can mount the skis after engaging his feet in the boots, knowing that should he experience a shock condition in the water, such as when he takes a tumble in the water, or otherwise comes to an abrupt or sudden halt therein, he will automatically be dismounted from the skis in the same manner as he would were he using shock-actuatable bindings on snow skis. That is, in accordance with the invention, the skis are equipped with bindings that releasably grip the boots, so that in the event of such an abrupt halt, the boots, and thus the user himself, are released from the bindings without injury to his ankles. This in turn leaves the user free to swim about in the water, devoid of the skis, and to go ashore or remount the skis, whichever is his choice. It also frees him from the fear and difficulty of having to extricate himself from the skis in the water, and particularly the fear of having to forcibly remove the bindings from his feet, and having to use his hands to do so while in the water, as was needed in the past when his feet were strapped to the skis with rubberized wraps. The boots are also light enough, yet also heavy enough in their construction, that they are no handicap to him as he swims in the water, either in the sense of over buoying his feet, or in the sense of weighting him down in the water.

The invention also makes it possible for the user to readily engage in slalom skiing, that is, skiing with his feet mounted in tandem on a single ski. Slalom skiing is a challenging sport, even with the invention. When he mounts his feet in tandem on a single ski, the user must place his feet in relatively close proximity to one another, turn sidewise, and bend his back leg at the knee. In this condition, he has little or no stability and he is challenged to stay erect, particularly when going through the various maneuvers mentioned above. Yet given the boots and bindings of the present invention, he is able to do so without fear of unduly stressing his ankles and lower legs to keep himself erect. In fact, he can slalom ski with the same ease, comfort, safety and maneuverability that he would have in skiing with his feet juxtaposed to one another, either on a single ski or on a pair of skis.

Many other advantages will also become apparent as the invention is explained more fully hereinafter; and while it will also be apparent that these advantages also lend themselves to downhill cross country snow skiing and the like, as well as to water skiing, the invention sharply contrasts with conventional downhill snow skiing in that the downhill snow skier has the stability of a hard surface, and is on a steep slope and under the pull of gravity, so that if anything, he must lean forward into the wind to keep his balance. Also, rather than react to the pull of a boat undergoing a turn, it is the skier himself who initiates turns by shifting his weight from side to side on the skis, and to do this he must remain substantially erect of the skis lest he will swerve out of control. In short, there is no occasion for crouching on the skis, with his lower legs in a low angle of dorsiflexion, and of course, no occasion for plantarflexion as he is pulled by something in front of him such as a boat.

Nevertheless, it is a fact that high top boots have been provided for snow skiers within which a limited degree of dorsiflexion was also provided, say, sixteen degrees or so forward of the vertical axis. See for example, the boot shown in U.S. Pat. No. 4,078,322. All such boots were designed, however, to keep the user's legs substantially stiff and erect for the reasons mentioned, and though dorsiflexion was provided, it was possible only against a hard surface, such as the ground below. In fact, snow ski boots typically cannot be held off of the ground and dorsiflexed through the muscle action of the user's legs alone. They must be dorsiflexed against an opposing surface, by leaning forward against the tension on them, and as indicated, even then, they severely limit the dorsiflexion which is possible, and are always incapable of the dorsiflexion needed for water skiing, i.e., upward of seventy degrees or more when crouching. Furthermore, they commonly have a stop which limits the dorsiflexion to some such figure as sixteen degrees, as does the spat, for example, at the instep of the boot in U.S. Pat. No. 4,078,322, and the rivets at the sides of the boot.

More particularly, the high top boot of the present invention comprises an open-topped shoe structure in which the user can insert the base of his foot, and this shoe structure includes an elongated sole plate for use under the plantar surface of his foot, and means that operatively define a holster within which the user can engage the metatarsal portion of his foot when the base of it is supported on the sole plate. The shoe structure also includes a wall structure that is substantially rigidly upstanding on the sole plate about the tarsal portion of the user's foot when the metatarsal portion of it is so engaged within the holster; and the wall structure includes a rear wall that upstands at the back of the shoe structure to a level above the ankle joint of the user's foot, to form a strongback for the achilles tendon of his foot. The boot further comprises a cuff-like super-structure which is engageable about the user's ankle when the base of his foot is inserted in the shoe structure. The superstructure includes a part annular upper cuff which is adapted to be removably secured about the user's lower leg above the ankle joint therein, and which is supported on the shoe structure at the top opening thereof, so as to have no more than limited capability to flex in relation to the shoe structure laterally thereof. The upper cuff is pivotally mounted on the wall structure to assume a normally upright position adjacent the strongback when the user's leg is relaxed and straightened at the knee, but sufficiently independent of the strong-back that when the user is supported on a body of water through the medium of a ski, with his feet in a pair of such boots, the cuff can pivot in conjunction with the user's lower leg, relative to the shoe structure, to any of the full range of positions into which the user may choose to pivot his lower leg for water skiing, including the low angle position needed when he squats or crouches for startup.

The boot has many embodiments, including ones in which the aforesaid structural combination further comprises means for releasably detaining the upper cuff in the normally upright position thereof, means whereby the upper cuff can pivot in relation to the strongback, and means responsive to the pivotal action of the upper cuff, relative to the strongback, to yieldably bias the upper cuff to reassume the normally upright position thereof when the user relaxes his lower leg and straightens it at the knee. In certain embodiments, the upper cuff is disposed to engage the strongback itself, when it pivots in relation to the strongback, and the biasing means are responsive to engagement of the upper cuff with the strongback to yieldably bias the upper cuff to resume the normally upright position thereof when the user relaxes his leg and straightens it at the knee, as indicated.

In some embodiments, the upper cuff is supported on the shoe structure so that the bottom portion of the same overlaps with the top portion of the strongback in the normally upright position of the upper cuff. However, one of the respective overlapping portions of the upper cuff and the strongback has a recess therein whereby the upper cuff can pivot in relation to the strongback when the user pivots his lower leg for water skiing, and the mutually opposing edge portions of the recess are sufficiently resiliently flexible to yieldably bias the upper cuff to resume the normally upright position thereof when the user relaxes his leg and straightens it at the knee.

In one group of embodiments, the top portion of the strongback takes the form of a part annular lower cuff having mutually opposing flanks which are adapted to extend opposite the user's ankle joint in the shoe structure. The upper and lower cuffs are assembled so that one telescopes within the other, and the upper cuff is pivotally mounted on the flanks of the lower cuff, preferably at points substantially coincident with the axis of the user's ankle joint. In certain embodiments, the bottom portion of the upper cuff has a rabbet in the relatively forwardly oriented face thereof, and the upper cuff is pivotally mounted on the flanks of the lower cuff so that the top portion of the upper cuff is sufficiently spaced apart from the holster in the normally upright position thereof to allow for the full range of positions into which the user may choose to dorsiflex his lower leg for water skiing, including the low angle position needed when he squats or crouches for startup. Meanwhile, the gap between the top portion of the upper cuff and the holster in the normally upright position of the upper cuff, is open, and the top portion of the upper cuff is divided into two relatively flexible flaps at the relatively forwardly oriented face thereof, and has fastener means on the respective flaps with which to removably secure the upper cuff about the user's lower leg above the ankle joint therein. In some embodiments, moreover, the upper cuff is telescoped within the lower cuff, and swales are formed in the wall structure between the flanks of the lower cuff and the holster so that the top portion of the upper cuff is sufficiently spaced apart from the sides of the shoe structure to allow for the full range of positions into which the user may choose to dorsiflex his lower leg for water skiing, including, again, the low angle position needed when he squats or crouches for startup.

Preferably, the rear wall upstands on the sole plate opposite the heel of the user's foot, so that the boot is closed at the heel. In addition, the wall structure is preferably interconnected with the holster at the sides of the shoe structure, so that the boot has continuously uninterrupted side walls behind the toe thereof.

In certain embodiments of the invention, the upper cuff is pivotally interconnected with the shoe structure by a pair of trunnions, and there are means on the respective trunnions whereby the upper cuff and the shoe structure can be adjustably clamped to one another, axially of the respective trunnions, to vary the capability of the upper cuff to flex in relation to the shoe structure laterally thereof. Additionally, in one special group of embodiments, one of the upper cuff and the shoe structure has substantially vertical slots therein, and the trunnions are slideably engaged in the slots to be adjusted heightwise of the boot for purposes of adjusting the upper cuff to varying leg lengths from one user to another.

In another group of embodiments, the boot is equipped with an insulative liner at the inner periphery thereof. And in certain of these, the liner is sock-like for wearing on the user's foot outside of the boot, and for insertion and removable into and from the boot with the user's foot at the time of use.

Like the top portion of the upper cuff, the top portion of the holster is preferably also divided into two relatively flexible flaps, and has fastener means on the respective flaps with which to removably secure the holster about the metatarsal portion of the user's foot when the user has inserted his foot in the shoe structure. Additionally, the holster preferably terminates short of the forward end of the sole plate, so that the boot is open-toed for the reasons mentioned earlier.

In another special group of embodiments, the holster and wall structure are formed as a monolithic shell of substantially rigid material. In some of these embodiments, the shell and sole plate are formed as two pieces, one of which is superposed on the other. In certain of them, the shell is superposed on the sole plate so that the lower longitudinal edges of the shell depend abreast of the corresponding longitudinal edges of the plate, and fasteners are applied to the respective pairs of edges to secure the shell to the plate at the respective longitudinal sides thereof.

In accordance with the invention, the combination commonly further comprises means on the opposing ends of the boot for attaching it to a ski at a releasable binding thereon. For example, in certain embodiments of the invention, the sole plate has first means on one end thereof whereby a tenon and mortise joint can be formed between the one end of the plate and cooperable second means for forming the same on the runner of the ski; and additional means on the opposing end thereof which are adapted to be releasably clamped between the runner and yieldable biasing means on the same, when the joint is formed at the one end of the plate. To illustrate, in some embodiments, the sole plate has a longitudinally projecting tenon on the one end thereof, and an obliquely notched projection on the other end thereof, which is adapted to be clamped between the runner and the yieldable biasing means when the tenon is engaged with a mortise on the runner of the ski, at the one end of the boot.

The ski itself commonly comprises an elongated runner having a pair of cleats on the dorsal side thereof which are spaced apart longitudinally of the runner to permit a user to place a foot-engaging shoe on the runner in the space between the cleats. Means are provided on the cleats for clamping the shoe to the runner, and the clamping means are operable to release the shoe when a predetermined shear force is generated between the runner and the shoe, transverse thereof. In many embodiments, the releasable clamping means include first means on one of the cleats for forming a tenon and mortise joint with cooperable second means for the same on the shoe, means on the other cleat for yieldably biasing the shoe and the second joint forming means relatively toward the first joint forming means on the one cleat, to form the joint at the one cleat when the shoe is placed between the cleats, and means on the other cleat for yieldably biasing the shoe relatively toward the runner, to releasably clamp the shoe thereto, when the joint is formed at the one cleat. In some embodiments, for example, the one cleat has a mortise therein, and the other cleat has a displaceable pin thereon which is yieldably biased in the direction of the mortise and disposed to engage the shoe at an obliquely angled notch in the adjacent end thereof, so as to releasably clamp the end of the shoe to the runner while biasing the first and second joint forming mean relatively together to form the joint.

Preferably, there are means on the other cleat for varying the bias on the pin; and this means may include a reciprocal actuator for alternately enlarging and reducing the bias on the pin when the shoe is releasably clamped between the pair of cleats. In some embodiments, for example, the actuator is mounted on the pin itself, to be reciprocated between a position in which the bias is enlarged and a position in which it is reduced. In certain of these embodiments, the actuator takes the form of a lever which is pivotally mounted on the pin and has a cam at one end thereof that enlarges the bias in one position of the lever, and reduces the bias in another position thereof. The cam may be interposed, for example, between the pin and a coiled spring which is caged in a thimble, coaxially of the pin, so that in the one position of the lever, the cam loads the spring, and in the other position of the lever, the cam unloads the spring in part.

In the case of a slalom ski, the runner may have three cleats spaced apart from one another on the dorsal side thereof, and the intermediate cleat may have dual first means, such as opposing mortises thereon, for forming a tenon and mortise joint with cooperable second means for the same on a pair of shoes placed on the runner in the spaces between the respective pairs of cleats. The remaining cleats, meanwhile, may have yieldable biasing means thereon to clamp the respective shoes to the runner while biasing the respective pairs of first and second joint forming means together to form the respective joints.

BRIEF DESCRIPTION OF THE DRAWINGS

These features will be better understood by reference to the accompanying drawings which illustrate a presently preferred embodiment of the boots, and also one of the bindings, as the boots and bindings are employed in conjunction with a single ski for slalom skiing purposes.

In the drawings.

BEST MODE FOR CARRYING OUT THE INVENTION

Figures 3, 7:
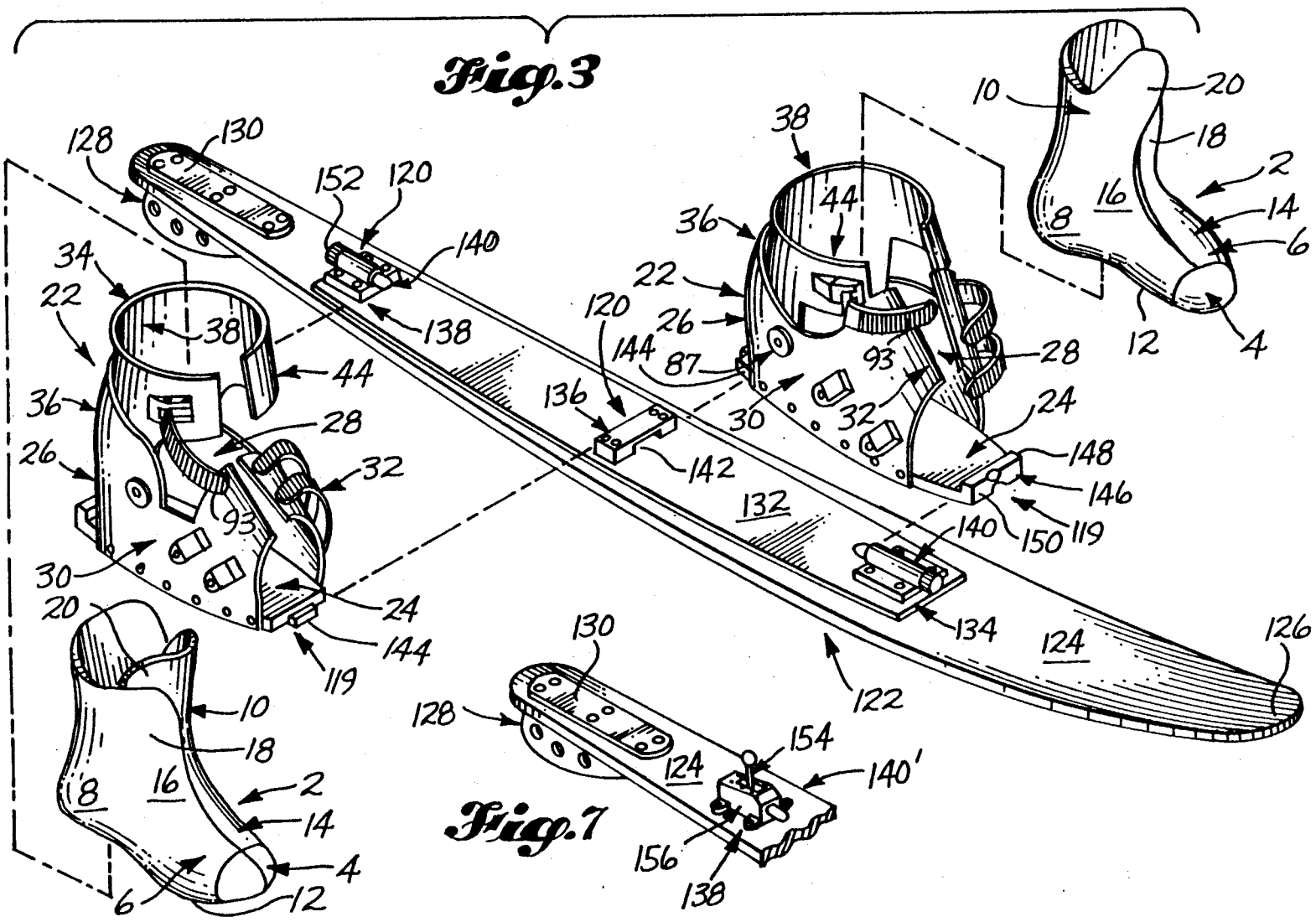
FIG. 3 is an exploded view of the ski and the boots, including the liners thereof.
FIG. 7 is a part perspective view of the ski when certain cleats in the bindings have been modified to provide reciprocable actuators for alternately enlarging and reducing the bias on the pins of the bindings when the boots are releasably clamped to the runner of the ski.

Referring to the drawings, it will be seen that the boot liners 2 in FIG. 3 are sock-like in appearance and resemble the human foot in that each has a toe portion 4 for the phalanges or toes of the foot, a metatarsal portion 6 therebehind for that portion of the foot, a tarsal portion 8 behind it for the equivalent platform-like portion of the human foot, and an upstanding portion 10 thereon for the ankle of the foot. The latter portion 10 commonly encloses the achilles tendon, as well as the tibia and fibula of the user's lower leg, and therefore, the joint at which the ankle rests on the tarsal portion 8 or platform of the foot. At its underside, the liner 2 has a plantar surface 12, like that of the foot, and at its top it has a dorsal surface 14 including an instep 16 which rises about the ankle of the user. Of course, the ankle in turn is at the bottom of the user's lower leg, and in waterskiing, this lower leg undergoes dorsiflexion and plantarflexion with respect to the plantar surface of the foot at the ankle joint of the user. The liner 2 is constructed from a rubber-coated Neoprene material which is lined with an insulative plastic foam material, and is commonly formed from a single sheet of the composite material which is shaped as a sock and sewn up about the toe portion 4 to form a pair of overlapping flaps 18 and 20 at the dorsal surface of the foot, the tops of which fold over the instep and close about the ankle to fully enclose the foot.

Referring now to the drawings as a whole, it will be seen that each boot 22 comprises an open topped shoe structure 26 in which the user can insert the base of his foot, and this shoe structure 26 includes an elongated sole plate 24 for use under the plantar surface of his foot, and means 32 that operatively define a holster within which the user can engage the metatarsal portion of his foot when the base of it is supported on the sole plate 24. The shoe structure 26 also includes a wall structure 30 that is substantially rigidly upstanding on the sole plate 24 about the tarsal portion of the user's foot when the metatarsal portion of it is so engaged within the holster 32, and the wall structure 30 includes a rear wall 36 that upstands at the back of the shoe structure 26 to a level above the ankle joint of the user's foot, to form a strongback for the achilles tendon of his foot. The boot further comprises a cuff-like superstructure 34 which is engageable about the user's ankle when the base of his foot is inserted in the shoe structure 26. The superstructure 34 includes a part annular upper cuff 38 which is adapted to be removably secured about the user's lower leg above the ankle joint therein, and which is supported on the shoe structure 26 at the top opening 28 thereof, so as to have no more than limited capability to flex in relation to the shoe structure laterally thereof. The upper cuff 38 is pivotally mounted on the wall structure 30 to assume a normally upright position adjacent the strongback 36 when the user's leg is relaxed and straightened at the knee, but sufficiently independent of the strongback 36 that when the user is supported on a body of water through the medium of the ski, with his feet in a pair of such boots 22, the cuff 38 can pivot in conjunction with the user's lower leg, relative to the shoe structure 26, to any of the full range of positions into which the user may choose to pivot his lower leg for water skiing, including the low angle position needed when he squats or crouches for startup. Additionally, there are means 42 for releasably detaining the upper cuff 38 in the normally upright position thereof, means 48 whereby the upper cuff can pivot in relation to the strongback 36, and means 50 responsive to the pivotal action of the upper cuff, relative to the strongback, to yieldably bias the upper cuff to resume the normally upright position thereof when the use relaxes his lower leg and straightens it at the knee.

More specifically, the plate 24 is constructed of stiff semi-rigid or substantially rigid plastic material, and is flared at the longitudinal edges 52 thereof to conform to the plantar surface of a human foot, including the greater widthwise dimension of the foot at the metatarsal portion thereof. The holster 32 and wall structure 30 are commonly molded as a monolithic shell 54 of stiff semi-rigid or substantially rigid plastic material which has an arched and slightly downwardly inclined cowl 32 at the forward end thereof, and a raised part cylindrical cuff 36 at the rear end thereof. The side walls 30 of the shell are spaced apart so that when the shell is mounted on the plate 24, the bottom edges 30' of the walls depend abreast of the plates at the corresponding edges 52 thereof. There is a rabbet 56 in the heel 58 of the cuff 36, however, so that in mounting the shell 52 on the plate 26, the heel 58 of the cuff can be rested on the plate at the rear end thereof, to leave the cuff upstanding in barrel-back fashion at the back of the plate. Meanwhile, the respective edges 30, and 52 of the shell and plate are predrilled or otherwise apertured, and a series of screws 60 or the like is applied to the edges through the holes 62 and 64 therein, to secure the shell to the plate.

The shell 54 is open ended at the toe 66, as seen, and shorter in length than the sole plate, so that when the user inserts his foot in the shoe structure 26 and rests it on the plate, the phalanges or toes of the user's foot project beyond the cowl 32 of the shell and onto the exposed forward end portion of the plate. At the sides, however, the tarsal and metatarsal portions of the user's foot are fully opposed by the walls 30 of the shell, and the tibia and fibula of his ankle joint are likewise opposed by the flanks 68 of the cuff 36. The flanks are interrupted, however, by a deep swale 70 in the ridge line of the shell, which leaves the tops of the flanks somewhat inclined to the tops 30'' of the walls 30, at the instep of the user's foot. The swale also leaves room for the upper cuff 38 of the superstructure 34 to pivot in relation to the cowl 32, despite the curvature of the cowl, as shall be explained.

The cowl 32 itself is preferably bifurcated to provide a pair of flaps 72 and 74 which have sufficient flexure capability to enable them to be separated and then reunited when the user inserts his foot within the shoe structure 26. In addition, when reunited, the flaps 72, 74 overlap one another, and conventional toggle type clasps 76 are provided on the relatively overlying flap 74, so that the cowl 32 can be fastened over the metatarsal portion of the user's foot, using tongues 78 that are ratcheted and insertable in releasable dogs 80 on the relatively underlying flap 72, to provide adjustability in the binding action of the respective clasps.

The upper cuff 38 of the superstructure 34 is molded as a monolithic tube 81 of stiff semi-rigid or substantially rigid plastic material which has a rabbet 82 in the bottom thereof, at the forwardly oriented face thereof. The rabbet 82 is deeply recessed in the tube, both horizontally and vertically thereof, but is adapted so that when the tube is mounted on the shoe structure 26, by telescopically engaging it in the opening 28 of the shoe structure, at the rear end thereof, the remaining collar 84 of material at the top of the tube can be employed in fastening the tube 81, and thus the boot 22 as a whole, to the user's leg, above the ankle joint therein. Meanwhile, the flanks 86 of the cuff 38 are directly opposed to the flanks 68 of the shell 54, so that the tube can be pivotally connected to the shoe structure by installing a pair of trunnion connections 87 between the respective pairs of flanks 86 and 68. The collar 84 and flanks 86 of the tube are sufficiently spaced from the cowl 32 of the shoe structure, however, that notwithstanding the telescopic engagement of the respective cuffs 36 and 38, there is a sufficient gap 88 (FIG. 1) between the cowl and the collar, at the flanks 68, 86 of the cuffs 36,38, to enable the tube to dorsiflex with respect to the shoe structure at the instep of the user's foot when he bends his leg at the knee, as shall be explained.

Like the cowl 32, the collar 84 is bifurcated to provide a pair of flaps 89 and 90 which have sufficient flexure capability that they can be separated and then reunited when the user inserts his foot within the shoe structure. Once again, moreover, a conventional toggle-type fastener 92 is provided on the relatively overlapping flap 89, with a ratcheted tongue 93 thereon, so that the flaps can be fastened together in variable dimension about the user's leg, using a releasable dog 94 on the relatively underlying flap 90 of the collar.

Both the cowl fastener means 76, 80, and the collar fastener means 92, 93, are secured in place with sets of male/female rivets 95 and 96, as shown. The trunnion connections 87 are formed from pairs of rivet-like male/female trunnion-forming members 97 and 98 which are interengaged with one another in pairs of opposing apertures 100 and 102 in the flanks 86 and 68 of the cuff 38 and shell 54. The pairs of members 96, 98 are secured in turn by cap screws 104 which are threadedly engaged in the shafts 106 of the female members 98 after passing through bores 108 in the male members 97.

Figures 1, 2, 4, 6:
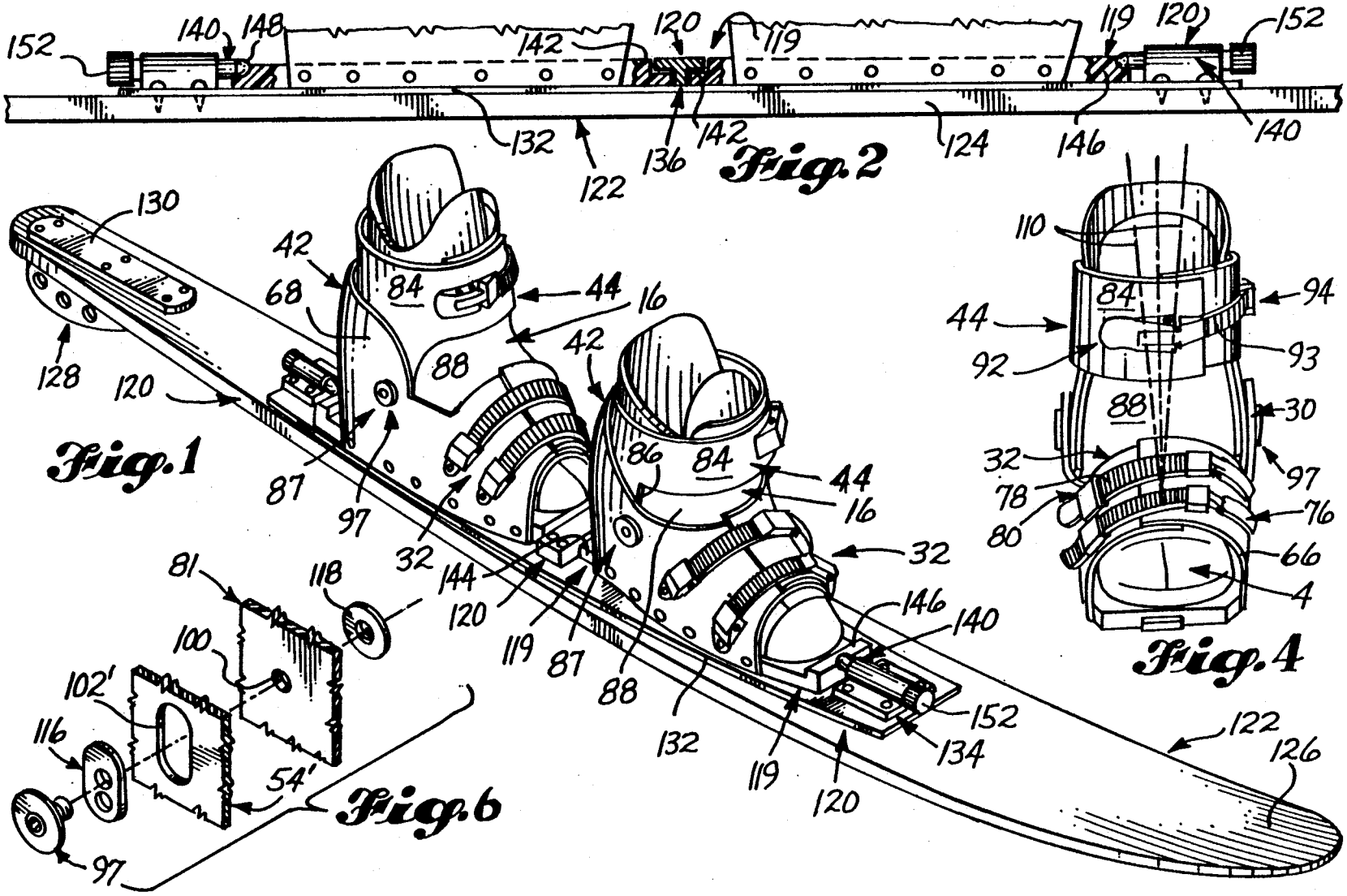
FIG. 1 is a perspective view of the slalom ski when the user's boots are mounted and secured thereon in the bindings of the ski.
FIG. 2 is a part cross-sectional, part side elevational view of the ski, illustrating the bindings in particular.
FIG. 4 is a front elevational view of one boot in the operative condition thereof.
FIG. 6 is an exploded perspective view of an adjustably clampable trunnion connection for the upper cuff of the boot.

It should now be apparent that when the user inserts his foot in the shoe structure 26, and fastens the collar 84 about his ankle to secure the boot 22 to his leg, the cuff sections 36, 38 form a compound cuff 44, the flanks 68, 86 of which limit the lateral deflection which his leg can undergo in water skiing, as seen at 110 in FIG. 4. His ankle is safely secured against inversion and eversion, therefore, even should he choose to bend his leg at the knee in making a turn to one side or the other of his skis, or ski. Moreover, should he choose to vary the deflection which his leg can undergo, the capscrews 104 can be adjusted to vary the clamping action of the respective pairs of trunnion-forming members 97, and this in turn will vary the capability of the cuff 38 to flex in relation to the shoe structure 26, laterally thereof. Meanwhile, regardless of the setting, the cuff 38 will articulate fore and aft of the skis or ski, so that the user can dorsiflex his lower leg for the various operations and maneuvers which are common to water skiing. As shall be explained, moreover, he will be able to do so for the full range of dorsiflexion which is required, i.e., upward of seventy degrees or more from the vertical.

To explain this, refer again to FIG. 1, where it will be seen firstly, that the gap 88 between the cowl 32 of the shoe structure 28, and the flanks 86 and collar 84 of the tube 81, is such as to make it possible for the tube to dorsiflex in relation to the shoe structure to the full extent needed. However, as the tube dorsiflexes in relation to the shoe structure, the heel 112 of the cuff 38 promptly abuts the inner wall of the cuff 36 of the shoe structure. Accordingly, the heel 112 of the cuff 38 has an inverted V-shaped notch 114 therein, which is sufficiently high and wide to assure that when the cuff 38 abuts the cuff 36 of the shoe structure, the remaining portions 112' of the cuff 38 at the flanks 86 of the heel, have sufficient flexure and room within the notch, to be able to flex relatively toward one another to the extent needed to enable the cuff 38 to continue to pivot in relation to the cuff 36. This in turn allows the tube to undergo the necessary dorsiflexion; but in addition, the yieldable heel portions 112' have the further function of providing a bias with which to return the tube 81 to the normally upright position thereof at the rear of the top opening 28 in the shoe structure, when the user returns his leg to the relatively straight condition thereof at the knee. Therefore, the cuff 38 not only safeguards the user's ankle and permits dorsiflexion of his lower leg, but in addition, returns itself naturally to the upright position, when the user straightens his leg.

To gain adjustability in the vertical disposition of the tube 81, and therefore, the size of the gap 88 as well, the apertures 100 and 102 in one of the tube and shoe structure may be more slot-like in configuration, as is the case with the apertures 102' in the shell 54' of FIG. 6. This enables the pair of trunnion connections 87 to be shifted vertically of the boot; or if desired, two-holed grommets 116 may be inserted in the apertures 102' to enable the pair of trunnion connections 87 to be given alternative positions, vertically of the boot, using the members 97, 98 to form the connections, with washers 118.

In an alternative arrangement, the tube 81 may be adapted to sleeve about the shell 54 at the cuff 36 thereof, and the notch 114 may be reversed and formed in the top of the cuff 36, to enable the remaining posterior portions 36' of the cuff 36, at the top thereof, to function in the manner of the heel portions 112, of the tube. Likewise, notches may be formed in both cuffs, at the respective overlapping portions thereof, to provide for plantarflexion of the user's leg as well, if desired.

As indicated earlier, the inventive boot 22 also makes it possible to employ shock releasable bindings on the water skis, when the user's boots are equipped with cooperable attachment means 119 on the sole plates 24 thereof. Moreover, the bindings may be mounted in tandem on a single ski, for slalom skiing, and these further features are illustrated in conjunction with one another in FIGS. 1–3, where the bindings are shown at 120 on an otherwise conventional ski 122 having an elongated runner 124, an upturned lip or shovel 126 at the front end thereof, and a stabilizer fin 128 at the rear end thereof. The fin 128 is suspended from the runner in conventional fashion, using a mounting plate 130 from which it depends below the underside of the runner. In known fashion, too, the runner may have a concave camber, lengthwise thereof, as well as a concavity transverse thereof. However, these features are not shown in the drawings, for ease in illustrating the invention itself.

Turning therefore to the bindings 120 themselves, it will be seen that at its center, the runner 124 has an elongated mounting plate 132 which is equipped in turn with three longitudinally spaced cleats 134, 136 and 138, the fore and aft of which, 134 and 138, have circumferentially encased, spring loaded pins 140 mounted thereon. The center cleat 136 is constructed differently, however, in that it has a taller and narrower shape, longitudinally of the runner, and has a pair of longitudinally opposing recesses 142 in the center thereof, at the level of the runner 124. The pins 140 of the fore and aft cleats 134, 138, are rounded and oppositely disposed to one another, fore and aft of the runner, and cooperate with the recesses 142 and the attachment means 119 on the boots, to releasably clamp the sole plates to the runner, when the user places his boots between the respective pairs of cleats 134, 136 and 136, 138, as shown.

Figure 5:
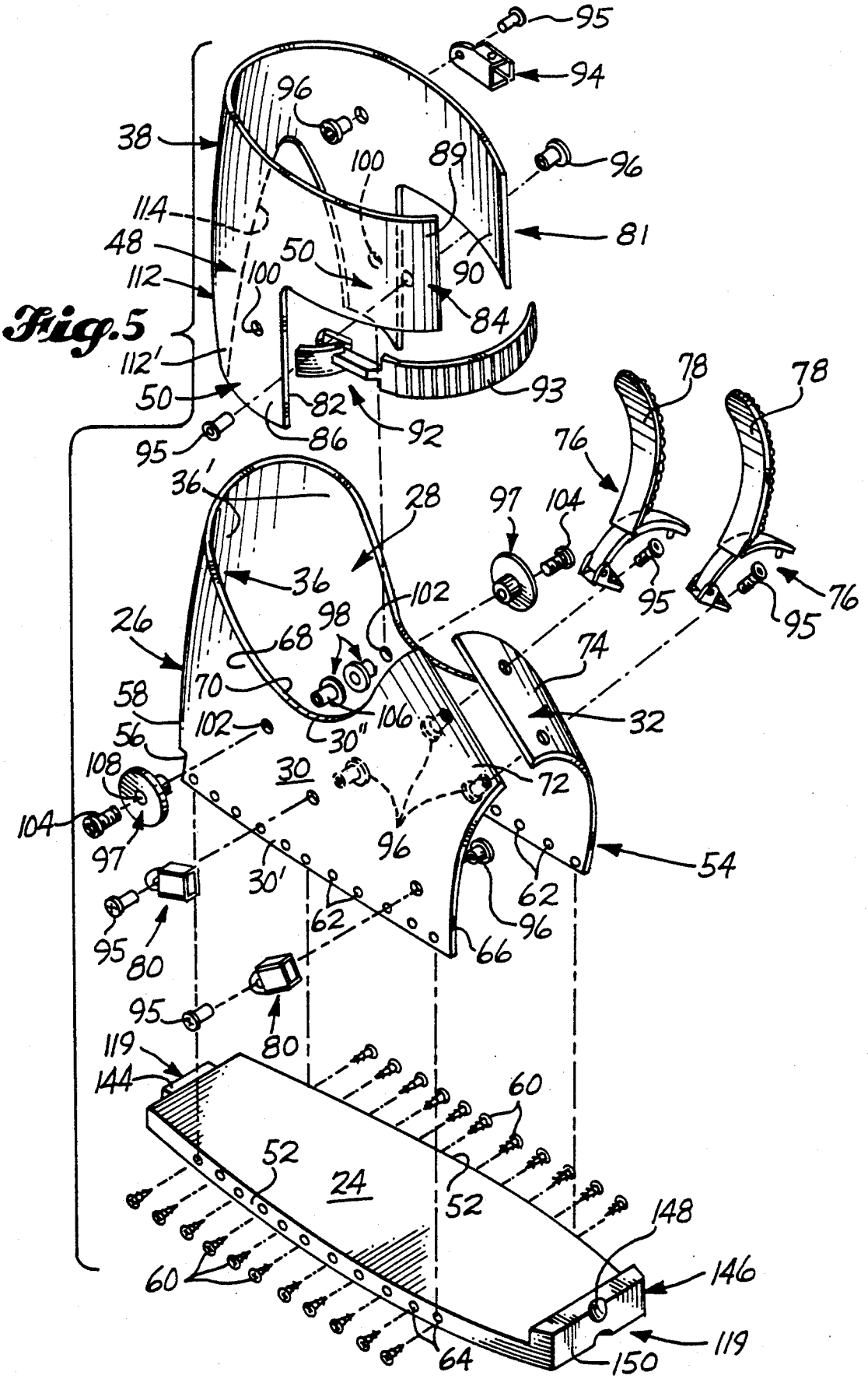
FIG. 5 is an exploded view of the boot in perspective.

Referring again to FIGS. 3 and 5, it will be seen that the sole plates 24 of the respective boots have inwardly extending tongues 144 on alternate ends thereof, and raised lips 146, with rounded notches 148, on the oppositely disposed ends thereof. The tongues 144 of the boots are adapted to slidably engage in the recesses 142 of the center cleat 136. The notches 148 are formed on the relatively outwardly facing edges 150 of the lips, at the centers thereof, and are adapted to receive the pins 140 of the fore and aft cleats 134, 138, when the tongues 144 of the boots are slidably engaged in the recesses 142 of the center cleat 136. In this way, the sole plates of the boots are yieldably biased by the pins into forming tenon and mortise joints with the center cleat, while the pins are at the same time releasably clamping the lips 146 of the boots to the runner of the ski at the opposing ends of the boots. Given sufficient loading on the pins 140, the arrangement tightly secures the boots 22 to the ski 122 for normal use of the ski in water skiing; but given shock pressure on the pins, such as when the user tumbles in the water, the boots can readily disengage from the runner 124 by overcoming the bias of the pins, there being sufficient gap between the respective pairs of cleats 134, 136 and 136, 138 to enable the boots to free themselves from the runner when the pins are depressed against the loading thereon.

Preferably, means 152 are provided, as shown, for adjusting the loading on the pins, and thus the shock pressure at which the boots are released from the runner when the user experiences a tumble or some other sudden or abrupt halt to his forward motion.

Figures 8, 9, 10, 11, 12:
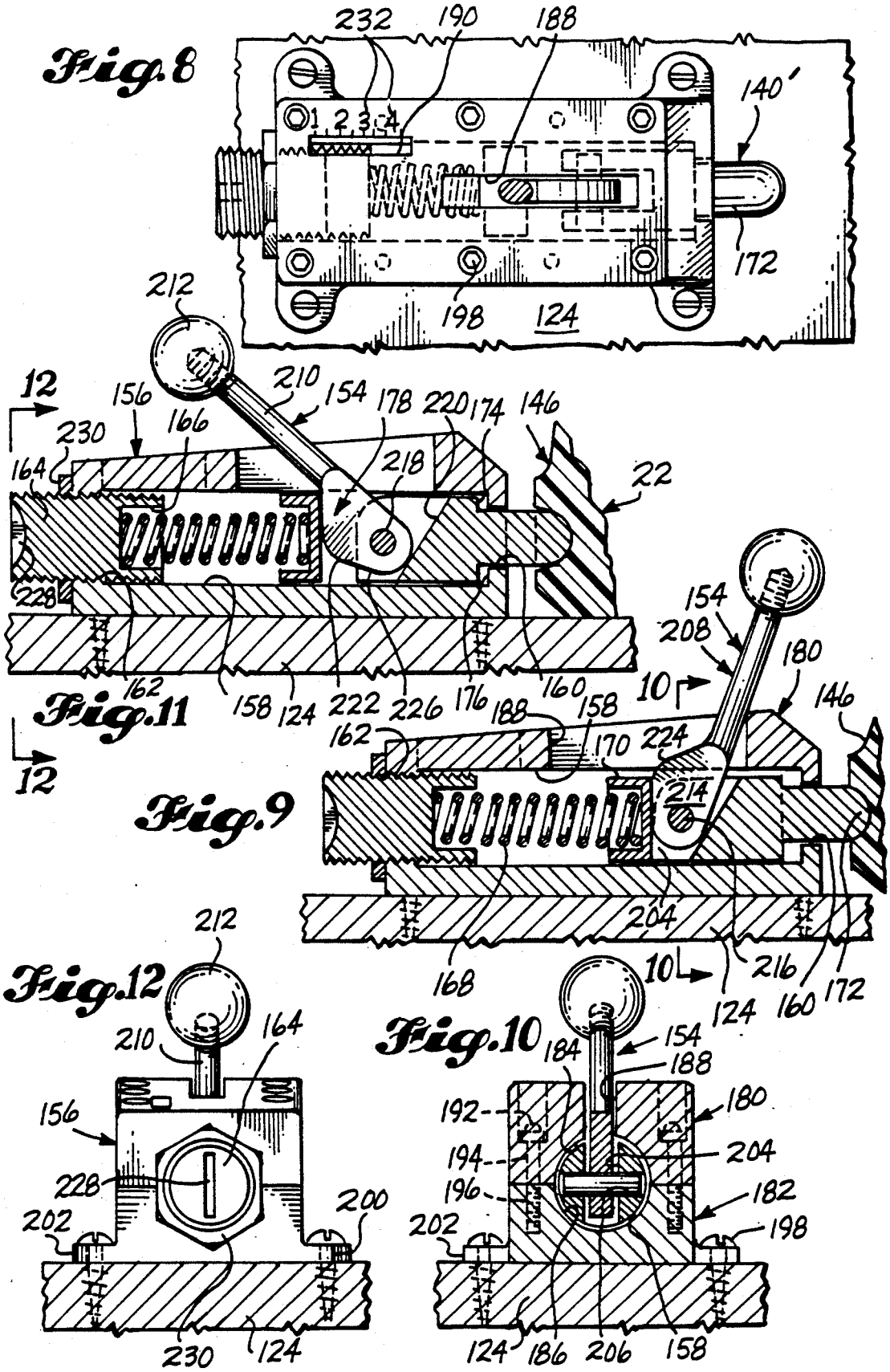
FIG. 8 is a plan view of one of the modified cleats.
FIG. 9 is a part cross sectional view of the one cleat along the axis of the bias, when its actuator is in the reduced bias position thereof.
FIG. 10 is a part cross sectional view of the one cleat along the line 10—10 of FIG. 9.
FIG. 11 is another part cross sectional view of the modified cleat along the axis of the bias, when the actuator is in the increased bias position thereof.
FIG. 12 is an end elevational view of the modified cleat along the line 12—12 of FIG. 11.

Referring now to FIGS. 7–12, it will be seen that the pins 140' of the fore and aft cleats 134 and 138 have been modified to include a reciprocable actuator 154 for varying the bias on the respective pins when the user has releasably clamped his boots 22 to the runner 124 between the pairs of cleats. Each of the pins 140' in the fore and aft cleats is slidably mounted in a two-part housing 156 which defines a cylindrical chamber 158 that opens in the direction of the center cleat 136 through a reduced diameter port 160 at one end of the housing. The chamber 158 also opens in the opposing direction at the other end of the housing, and the latter opening 162 is threaded to receive a threaded plug 164 which has a cylindrical recess 166 in the forward end thereof to serve as a thimble for the coiled spring 168 of the cleat. The spring 168 is equipped with a cap 170 and is caged between the plug 164 and the pin 140' in the chamber so as to bias the pin in the direction of the port 160. The pin, meanwhile, has a rounded, reduced diameter nose 172 on the forward end thereof, which protrudes through the port under the bias of the spring until the shoulder 174 thereof abuts the forward end 176 of the chamber at the inside of the port. When the pin is engaged by a boot, it is loaded against the bias of the spring, and the shoulder 174 of the pin is displaced inward from the end 176 of the chamber, as seen in FIG. 9. However, the actuator 154 is interposed between the spring and the pin and is equipped with a cam 178 so that when the actuator is put to use, it increases the bias of the spring and reduces the gap between the shoulder 174 and the end 176 of the chamber to that seen in FIG. 11, as shall be explained.

More specifically, the two parts 180 and 182 of the housing 156 are adapted to be superposed on one another, and have mutually opposing semi-cylindrical grooves 184 and 186 therein which define the chamber 158 of the housing when the parts are relatively superposed on one another. The relatively upper part 180 also has a pair of slots 188 and 190 therein, one of which, 188, is elongated fore and aft of the housing, and disposed in the vertical axial plane of the chamber, to open into the top of the same at the point where the cap 170 engages the pin 140'. The other slot, 190, is shorter and offset to one side of the chamber, but again opens into the top of the chamber, for reasons which will be explained. Pairs of capscrews 192 are employed in securing the parts to one another at rows of counterbored holes 194 and 196 in the respective parts at each side of the chamber; and sets of screws 198 are employed in holes 200 in pairs of flanges 202 on the relatively forward and rearward ends of the relatively lower part 182 to anchor the housing as a whole to the runner.

Referring now to the internal workings of the device, it will be seen that the pin 140' has a vertical slot 204 in the rear end portion thereof which is accompanied by a pair of holes 206 that are opposed to one another across the slot in the horizontal axial plane of the chamber. The actuator 154 comprises an elongated lever 208, the upper end portion 210 of which is upstanding in the slot 188 of the housing, with a knob 212 threaded thereto, and the lower end portion 214 of which is inserted in the slot 204 of the pin and clevised to the pin by means of a trunnion 216 inserted through a hole 218 in the lever between the holes 206 of the pin. The forward end 220 of the slot 204 of the pin is obliquely inclined to the axis of the chamber, and the lower end portion 214 of the lever has the cam 178 formed on the rearwardly oriented face thereof, and the cam in turn has a lobe 222 and a pair of flats 224 and 226 on the relatively upper and lower flanks thereof. The flats 224 and 226 angle into the upper body 210 and lower end of the lever 208, respectively, and have radii about the axis of the trunnion 216 adapted to generate a differential between the two positions of the actuator seen in FIGS. 9 and 11, respectively. The radius of the lower flat 226 is generally equivalent to that of the rear end of the pin about the axis of the trunnion, so that in the position of FIG. 9, the actuator 154 is relatively deactuated in that the cap 170 of the spring 168 engages the rear end of the pin as seen. The radius of the upper flat 224 is considerably greater, however, so that in the position of FIG. 11, the cap 170 is engaged by the flat 224 and driven rearwardly of the pin to increase the loading on the spring, and thereby the bias of the spring on the pin in the direction of the port 160.

In the relatively inactive position of FIG. 8, the lever 208 is upright in the slot 188 of the housing, and the shoulder 174 of the pin is engaged with the end 176 of the chamber. When the user inserts his boot between the corresponding pair of cleats, the sole plate 24 of his boot effectively displaces the pin 140' against the bias of the spring 168, and in doing so, displaces the shoulder 174 of the pin rearward of the end 176 of the chamber to the position of FIG. 9. The lever, meanwhile, rotates slightly forward to the position seen in FIG. 9, when the cap 170 of the spring remains engaged with the pin as seen. With his boot thus engaged between the cleats and partially loaded by the spring of the cleat 138, the user may then grasp the knob 212 of the lever and rotate the lever rearwardly of the slot 188, to engage the upper flat 224 of the cam 178 with the cap of the spring. This in turn increases the loading of the spring on the user's boot, to more firmly clamp it to the runner of the ski. The pin, meanwhile, is displaced once again toward the port 160, to partially close the gap between the shoulder 174 and the end 176 of the chamber.

The loading on the spring is also a function of the setting of the plug 164 in the rear end of the chamber. As indicated, the plug 164 is threadedly engaged in the opening 162 of the same, and can be advanced and retracted to vary the loading on the spring by turning it with a screwdriver or some other such tool in a slot 278 at the rear of the plug. Thereafter, a lockwasher 230 is employed to set the position of the plug when the desired compression is achieved. To gauge the compression, moreover, the slot 190 is disposed above the forward end portion of the plug, and is accompanied by numbers or other markings 232 which indicate the degree of compression applied to the spring by the plug.

In lieu of the adjustable buckle or clasp seen at 92, 93 in FIGS. 1–5, a bladder (not shown) can be interposed between the user's foot and the instep of the boot, for inflation by a gas or gel to secure the cuff about the user's lower leg.

The reverse arrangement of the respective pairs of tongues 144 and lips 146 on the plates 24 of the boots is not necessary, but facilitates slalom skiing on a single ski as shown, in that it enables the boots to be closely spaced to one another for the comfort and safety of the user. Otherwise, the boots are interchangeable with one another from the right foot to the left foot, or vice versa. In fact, for purposes of skiing on a pair of side-by-side skis, the respective pairs of tongues and lips may be disposed on corresponding ends of the boots, to render them fully interchangeable.

Preferably, all components of the apparatus are floatable, so as to be readily recoverable from the water when removed from the user's person.

The liner 2 is optional, but something which lends itself to the safety and comfort of the user. Rather than being a separate item, moreover, the liner may be incorporated into the boot itself, as a lining formed on the inner periphery thereof. In addition, rather than there being open gaps 88 and open notches 114 in the boots, the gaps 88 between the collars 84 and cowls 32 of the boots, and the notches 114 in the cuffs 38 of the tubes 81, or the shells, may be closed by suitable collapsible, foldable or flexible material (not shown) which, when stretched across the respective gaps or notches, will occupy the same within the surrounding edges of the boots.

The open toe 66 is also optional, but lends itself to the comfort of the user in that it minimizes frictional contact between the foot and the structure of the boot.

We claim:

1. In a high top boot with which a user can mount his foot on a water ski and undergo water skiing thereon, the combination of an open topped shoe structure in which the user can insert the base of his foot, including an elongated sole plate for use under the plantar surface of his foot, means that operatively define a holster within which the user can engage the metatarsal portion of his foot when the base of it is supported on the sole plate, and a wall structure that is substantially rigidly upstanding on the sole plate about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releaseably detaining the upper cuff in the normally upright position thereof, said upper cuff and holster having terminal edge portions thereof which oppose one another across the instep of the user's foot, and which are spaced apart from one another by a gap when the upper cuff is releaseably detained in the normally upright position thereof, and means in the releasable detention means and means in the gap and across the instep of the boot opposite the gap whereby the upper cuff can pivot in conjunction with the user's lower leg, relative to the shoe structure, at angles sufficiently upward of about 70° that the user can pivot his lower leg over the full range of positions needed for waterskiing, including the low angle position of dorsiflexure needed when he squats or crouches for startup.

2. The high top boot according to claim 1 wherein the top portion of the strongback takes the form of a part annular lower cuff having mutually opposing flanks which are adapted to extend opposite the user's ankle joint in the shoe structure, the upper and lower cuffs are assembled so that one telescopes within the other, and the upper cuff is pivotally mounted on the flanks of the lower cuff.

3. The high top boot according to claim 2 wherein the upper cuff is pivotally mounted on the flanks of the lower cuff at points substantially coincident with the axis of the user's ankle joint.

4. The high top boot according to claim 2 wherein the bottom portion of the upper cuff has a rabbet in the relatively forwardly oriented face thereof, and the upper cuff is pivotally mounted on the flanks of the lower cuff so that the top portion of the upper cuff is sufficiently spaced apart from the holster in the normally upright position thereof to allow for the full range of positions into which the user may choose to dorsiflex his lower leg for water skiing, including the low angle position needed when he squats or crouches for startup.

5. The high top boot according to claim 4 wherein in the normally upright position of the upper cuff, the gap between the top portion of the upper cuff and the holster has an opening therein within which the top portion and the holster can pivot relatively toward one another while the cuff assumes the full range of positions into which the user may wish to pivot his lower leg when water skiing, including the low angle dorsiflexed position needed when he squats or crouches for startup.

6. The high top boot according to claim 5 wherein the top portion of the upper cuff is divided into two relatively flexible flaps at the relatively forwardly oriented face thereof, and has fastener means on the respective flaps with which to removably secure the upper cuff about the user's lower leg above the ankle joint therein.

7. The high top boot according to claim 6 wherein the upper cuff is telescoped within the lower cuff, and swales are formed in the wall structure between the flanks of the lower cuff and the holster so that the top portion of the upper cuff is sufficiently spaced apart from the sides of the shoe structure to allow for the full range of positions into which the user may choose to dorsiflex his lower leg for water skiing, including the low angle position needed when he squats or crouches for startup.

8. The high top boot according to claim 1 wherein the rear wall upstands on the sole plate opposite the heel of the user's foot, so that the boot is closed at the heel.

9. The high top boot according to claim 1 wherein the wall structure is interconnected with the holster at the sides of the shoe structure, so that the boot has continuously uninterrupted side walls behind the toe thereof.

10. The high top boot according to claim 1 wherein the upper cuff is pivotally interconnected with the shoe structure by a pair of trunnions, and there are means on the respective trunnions whereby the upper cuff and the shoe structure can be adjustably clamped to one another, axially of the respective trunnions, to vary the capability of the upper cuff to flex in relation to the shoe structure laterally thereof.

11. The high top boot according to claim 10 wherein one of the upper cuff and the shoe structure has substantially vertical slots therein, and the trunnions are shiftably engageable in the slots to be adjusted height-wise of the boot for purposes of adjusting the upper cuff to varying leg lengths from one user to another.

12. The high top boot according to claim 1 wherein the combination further comprises an insulative liner at the inner periphery of the boot.

13. The high top boot according to claim 12 wherein the liner is sock-like for wearing on the user's foot outside of the boot, and for insertion and removable into and from the boot with the user's foot at the time of use.

14. The high top boot according to claim 1 wherein the top portion of the holster is divided into two relatively flexible flaps, and has fastener means on the respective flaps with which to removably secure the holster about the metatarsal portion of the user's foot when the user has inserted his foot in the shoe structure.

15. The high top boot according to claim 1 wherein the holster terminates short of the forward end of the sole plate, so that the boot is open-toed.

16. The high top boot according to claim 1 wherein the holster and wall structure are formed as a monolithic shell of substantially rigid material.

17. The high top boot according to claim 16 wherein the shell and sole plate are formed as two pieces, one of which is superposed on the other.

18. The high top boot according to claim 17 wherein the shell is superposed on the sole plate so that the lower longitudinal edges of the shell depend abreast of the corresponding longitudinal edges of the plate, and fasteners are applied to the respective pairs of edges to secure the shell to the plate at the respective longitudinal sides thereof.

19. The high top boot according to claim 1 further comprising means on the opposing ends of the boot for attaching it to a ski at a releasable binding thereon.

20. The high top boot according to claim 19 wherein the sole plate has first means on one end thereof whereby a tenon and mortise joint can be formed between the one end of the plate and cooperable second means for forming the same on the runner of the ski, and additional means on the opposing end thereof which are adapted to be releasably clamped between the runner and yieldable biasing means on the same, when the joint is formed at the one end of the plate.

21. The high top boot according to claim 20 wherein the sole plate has a longitudinally projecting tenon on the one end thereof, and an obliquely notched projection on the other end thereof, which is adapted to be clamped between the runner and the yieldable biasing means when the tenon is engaged with a mortise on the runner of the ski, at the one end of the boot.

22. The high top boot according to claim 1 wherein the combination further comprises means responsive to the pivotal action of the upper cuff, relative to the shoe structure, to yieldably bias the upper cuff to resume the normally upright position thereof when the user relaxes his lower leg and straightens it at the knee.

23. The high top boot according to claim 22 wherein the strongback is disposed to detain the upper cuff in the normally upright position thereof, means are operatively interposed between the strongback and the upper cuff whereby the upper cuff is releasable from detention for pivoting in conjunction with the user's lower leg, relative to the strongback, when the user pivots his lower leg for water skiing, and the biasing means are responsive to the pivotal action of the upper cuff, to yieldably bias the upper cuff to resume the normally upright position thereof when the user relaxes his leg and straightens it at the knee.

24. The high top boot according to claim 22 wherein the upper cuff is supported on the shoe structure so that the bottom portion of the same overlaps with the top portion of the strongback in the normally upright position of the upper cuff, and wherein one of the respective overlapping portions of the upper cuff and the strongback has a recess therein whereby the upper cuff can pivot in relation to the strongback when the user pivots his lower leg for water skiing, and the mutually opposing edge portions of the recess are sufficiently resiliently flexible to yieldably bias the upper cuff to resume the normally upright position thereof when the user relaxes his leg and straightens it at the knee.

25. The high top boot according to claim 1 wherein in the normally upright position of the upper cuff, the gap between the opposing terminal edge portions of the upper cuff and the holster has an opening therein within which said portions can pivot relatively toward one another while the cuff assumes the full range of positions into which the user may wish to pivot his lower leg when water skiing, including the low angle dorsiflexed position needed when he squats or crouches for startup.

26. In a ski for use in water skiing, the combination of an elongated runner, and a high top boot that is upstanding on the runner and comprises an open topped shoe structure in which the user can insert the base of his foot, for mounting his foot on the ski, including means that operatively define a holster within which the user can engage the metatarsal portion of his foot when the base of it is supported on the runner, and a wall structure that is substantially rigidly upstanding on the runner about the tarsal portion of the user's foot when the metatarsal portion of it is so engaged within the holster.

said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releasably detaining the upper cuff in the normally upright position thereof, said upper cuff and holster having terminal edge portions thereof which oppose one another across the instep of the user's foot, and which are spaced apart from one another by a gap when the upper cuff is releasably detained in the normally upright position thereof, and means in the releasable detention means and means in the gap and across the instep of the boot opposite the gap whereby the upper cuff can pivot in conjunction with the user's lower leg, relative to the shoe structure, at angles sufficiently upward of about 70° that the user can pivot his lower leg over the full range of positions needed for waterskiing, including the low angle position of dorsiflexure needed when he squats or crouches for startup.

27. The ski according to claim 26 wherein the combination further comprises means responsive to the pivotal action of the upper cuff, relative to the shoe structure, to yieldably bias the upper cuff to resume the normally upright position thereof when the user relaxes his lower leg and straightens it at the knee.

28. The ski according to claim 27 wherein the strongback is disposed to detain the upper cuff in the normally upright position thereof, means are operatively interposed between the strongback and the upper cuff whereby the upper cuff is releasable from detention for pivoting in conjunction with the user's lower leg, relative to the strongback, when the user pivots his lower leg for water skiing, and the biasing means are responsive to the pivotal action of the upper cuff, to yieldably bias the upper cuff to resume the normally upright position thereof when the user relaxes his leg and straightens it at the knee.

29. The ski according to claim 27 wherein the upper cuff is supported on the shoe structure so that the bottom portion of the same overlaps with the top portion of the strongback in the normally upright position of the upper cuff, and wherein one of the respective overlapping portions of the upper cuff and the strongback has a recess therein whereby the upper cuff can pivot in relation to the strongback when the user pivots his lower leg for water skiing, and the mutually opposing edge portions of the recess are sufficiently resiliently flexible to yieldably bias the upper cuff to resume the normally upright position thereof when the user relaxes his leg and straightens it at the knee.

30. The ski according to claim 26 wherein in the normally upright position of the upper cuff, the gap between the opposing terminal edge portions of the upper cuff and the holster has an opening therein within which said portions can pivot relatively toward one another while the cuff assumes the full range of positions into which the user may wish to pivot his lower leg when water skiing, including the low angle dorsiflexed position needed when he squats or crouches for startup.

31. The ski according to claim 26 wherein the combination further comprises an elongated sole plate which is secured to the runner at the dorsal side thereof and has the boot upstanding thereon.

32. The ski according to claim 31 wherein the shell and sole plate are formed as two pieces, one of which is superposed on the other.

33. The ski according to claim 32 wherein the shell is superposed on the sole plate so that the lower longitudinal edges of the shell depend abreast of the corresponding longitudinal edges of the plate, and fasteners are applied to the respective pairs of edges to secure the shell to the plate at the respective longitudinal sides thereof.

34. The ski according to claim 31 wherein the sole plate and runner have cooperatively engageable means thereon adjacent one end of the plate, whereby a tenon and mortise joint is formed between the one end of the plate and the runner, and there are additional means on the runner, including yieldable biasing means, whereby the opposing end of the plate is releasably clamped between the runner and the yieldable biasing means when the joint is formed at the one end of the plate.

35. The ski according to claim 34 wherein the sole plate has a longitudinally projecting tenon on the one end thereof, and the runner has a mortise adjacent the one end of the plate, with which the tenon is engaged, and wherein the plate has an obliquely notched projection on the other end thereof, which is adapted to be clamped between the runner and the yieldable biasing means when the tenon is engaged with the mortise on the runner at the one end of the plate.

36. The ski according to claim 31 wherein the combination further comprises a pair of cleats on the dorsal side of the runner which are spaced apart longitudinally of the runner and have the sole plate positioned in the space therebetween, and means on the cleats for clamping the plate to the runner, the clamping means being operable to release the plate when a predetermined shear force is generated between the ski and the plate, transverse thereof.

37. The ski according to claim 36 wherein the clamping means include a displaceable pin on one of the cleats for yieldably biasing the plate relatively toward the runner, to releasably clamp the plate thereto, and the combination further comprises means including a reciprocable actuator on said one cleat for alternately enlarging and reducing the bias on the pin, when the plate is releasably clamped to the runner.

38. The ski according to claim 37 wherein the actuator takes the form of a lever which is pivotally mounted on the pin and has a cam at one end thereof that enlarges the bias in one position of the lever, and reduces the bias in another position thereof.

39. The ski according to claim 38 wherein the cam is interposed between the pin and a coiled spring which is caged in a thimble, coaxially of the pin, so that in the one position of the lever, the cam loads the spring, and in the other position of the lever, the cam unloads the spring in part.

40. The ski according to claim 26 wherein the top portion of the strongback takes the form of a part annular lower cuff having mutually opposing flanks which are adapted to extend opposite the user's ankle joint in the shoe structure, the upper and lower cuffs are assembled so that one telescopes within the other, and the upper cuff is pivotally mounted on the flanks of the lower cuff.

41. The ski according to claim 40 wherein the upper cuff is pivotally mounted on the flanks of the lower cuff at points substantially coincident with the axis of the user's ankle joint.

42. The ski according to claim 40 wherein the bottom portion of the upper cuff has a rabbet in the relatively forwardly oriented face thereof, and the upper cuff is pivotally mounted on the flanks of the lower cuff so that the top portion of the upper cuff is sufficiently spaced apart from the holster in the normally upright position thereof to allow for the full range of positions into which the user may choose to dorsiflex his lower leg for water skiing, including the lower angle position needed when he squats or crouches for startup.

43. The ski according to claim 42 wherein in the normally upright position of the upper cuff, the gap between the top portion of the upper cuff and the holster has an opening therein within which the top portion and the holster can pivot relatively toward one another while the cuff assumes the full range of positions into which the user may wish to pivot his lower leg when water skiing, including the low angle dorsiflexed position needed when he squats or crouches for startup.

44. The ski according to claim 43 wherein the top portion of the upper cuff is divided into two relatively flexible flaps at the relatively forwardly oriented face thereof, and has fastener means on the respective flaps with which to removably secure the upper cuff about the user's lower leg above the ankle joint therein.

45. The ski according to claim 44 wherein the upper cuff is telescoped within the lower cuff, and swales are formed in the wall structure between the flanks of the lower cuff and the holster so that the top portion of the upper cuff is sufficiently spaced apart from the sides of the shoe structure to allow for the full range of positions into which the user may choose to dorsiflex his lower leg for water skiing, including the low angle position needed when he squats or crouches for startup.

46. The ski according to claim 26 wherein the rear wall upstands on the rubber opposite the heel of the user's foot, so that the boot is closed at the heel.

47. The ski according to claim 26 wherein the wall structure is interconnected with the holster at the sides of the shoe structure, so that the boot has continuously uninterrupted side walls behind the toe thereof.

48. The ski according to claim 26 wherein the upper cuff is pivotally interconnected with the shoe structure by a pair of trunnions, and there are means on the respective trunnions whereby the upper cuff and the shoe structure can be adjustably clamped to one another, axially of the respective trunnions, to vary the capability of the upper cuff to flex in relation to the shoe structure laterally thereof.

49. The ski according to claim 48 wherein one of the upper cuff and the shoe structure has substantially vertical slots therein, and the trunnions are shiftably engageable in the slots to be adjusted heightwise of the boot for purposes of adjusting the upper cuff to varying leg lengths from one user to another.

50. The ski according to claim 26 wherein the combination further comprises an insulative liner at the inner periphery of the boot.

51. The ski according to claim 50 wherein the liner is sock-like for wearing on the user's foot outside of the boot, and for insertion and removable into and from the boot with the user's foot at the time of use.

52. The ski according to claim 26 wherein the top portion of the holster is divided into two relatively flexible flaps, and has fastener means on the respective flaps with which to removably secure the holster about the metatarsal portion of the user'foot when the user has inserted his foot in the shoe structure.

53. The ski according to claim 26 wherein the holster terminates short of the forward end of the sole plate, so that the boot is open-toed.

54. The ski according to claim 26 wherein the holster and wall structure are formed as a monolithic shell of substantially rigid material.

55. The ski according to claim 26 wherein the runner has a stabilizer fin suspended from the underside thereof.

56. In apparatus for water skiing, the combination of a water ski comprising an elongated runner having a pair of cleats on the dorsal side thereof which are spaced apart longitudinally of the runner, and a high top boot with which a user can mount his foot on the water ski, said boot comprising an open topped shoe structure in which the user can insert the base of his foot, including an elongated sole plate for use under the plantar surface of his foot, means that operatively define a holster within which the user can engage the metatarsal portion of his foot when the base of it is supported on the sole plate, and a wall structure that is substantially rigidly upstanding on the sole plate about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releasably detaining the upper cuff in the normally upright position thereof, said upper cuff and holster having terminal edge portions thereof which oppose one another across the instep of the user's foot, and which are spaced apart from one another by a gap when the upper cuff is releasably detained in the normally upright position thereof, and means in the releasable detention means and means in the gap and across the instep of the boot opposite the gap whereby the upper cuff can pivot in conjunction with the user's lower leg, relative to the shoe structure, to any of the full range of positions into which the user may choose to pivot his lower leg for water skiing, including the low angle position of dorsiflexure needed when he squats or crouches for startup, said sole plate being adapted to be positioned in the space between the cleats of the runner, there being means on the cleats for clamping the boot to the runner, and the clamping means being operable to release the boot when a predetermined shear force is generated between the ski and the boot transverse thereof.

57. The apparatus according to claim 56 wherein there are three cleats on the dorsal side of the runner, which are spaced apart from one another longitudinally of the runner to permit a pair of the boots to be placed on the runner in the spaces between the respective pairs of cleats, the respective pairs of cleats having means thereon for clamping the pair of boots to the runner, and the clamping means being operable to release each of the pair of boots when a predetermined shear force is generated between the runner and the respective boot, transverse thereof.

58. The ski according to claim 56 wherein the releasable clamping means include means on one of the cleats for forming a tenon and mortise joint with the boot, means on the other cleat for yieldably biasing the boot relatively toward the joint forming means on the one cleat, to form the joint at the one cleat when the boot is positioned between the cleats, and means on the other cleat for yieldably biasing the boot relatively toward the runner, to releasably clamp the boot thereto, when the joint is formed at the one cleat.

59. The ski according to claim 58 wherein the one cleat has a mortise therein and the other cleat has a displaceable pin thereon which is yieldably biased in the direction of the mortise and disposed to engage the boot at an obliquely angled notch in the adjacent end thereof, so as to releasably clamp the end of the boot to the runner while biasing the boot relatively toward the mortise to form the joint.

60. The apparatus according to claim 56 further comprising means responsive to the pivotal action of the upper cuff, relative to the shoe structure, to yieldably bias the upper cuff to resume the normally upright position thereof when the user relaxes his lower leg and straightens it at the knee.

61. The apparatus according to claim 60 wherein the upper cuff is supported on the shoe structure so that the bottom portion of the same overlaps with the top portion of the strongback in the normally upright position of the upper cuff, and wherein one of the respective overlapping portions of the upper cuff and the strongback has a recess therein whereby the upper cuff can pivot in relation to the strongback when the user pivots his lower leg for water skiing, and the mutually opposing edge portions of the recess are sufficiently resiliently flexible to yieldably bias the upper cuff to resume the normally upright position thereof when the user relaxes his leg and straightens it at the knee.

62. The apparatus according to claim 56 wherein in the normally upright position of the upper cuff, the gap between the opposing terminal edge portions of the upper cuff and the holster has an opening therein within which said portions can pivot relatively toward one another while the cuff assumes the full range of positions into which the user may wish to pivot his lower leg when water skiing, including the low angle dorsiflexed position needed when he squats or crouches for startup.

63. In a high top boot with which a user can mount his foot on a water ski, the combination of an open topped shoe structure in which the user can insert the base of his foot, including an elongated sole plate for use under the plantar surface of his foot, means that operatively define a holster within which the user can engage the metatarsal portion of his foot when the base of it is supported on the sole plate, and a wall structure that is substantially rigidly upstanding on the sole plate about the tarsal portion of the user's foot when the metatarsal portion of it is so engaged within the holster, said wall structure including a rear wall that upstands at the back of the shoe structure to a level about the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, but sufficiently independent of the strongback that when the user is supported on a body of water through the medium of a ski, with his feet in a pair of such boots, the cuff can pivot in conjunction with the user's lower leg, relative to the shoe structure, to any of the full range of positions into which the user may choose to pivot his lower leg for water skiing, including the low angle position needed when he squats or crouches for startup, the combination further comprising means for releasably detaining the upper cuff in the normally upright position thereof, means whereby the upper cuff can pivot in relation to the strongback, and means responsive to the pivotal action of the upper cuff, relative to the strongback, to yieldably bias the upper cuff to resume the normally upright position thereof when the user relaxes his lower leg and straightens it at the knee, the upper cuff being supported on the shoe structure so that the bottom portion of the same overlaps with the top portion of the strongback in the normally upright position of the upper cuff, one of the respective overlapping portions of the upper cuff and the strongback having a recess therein whereby the upper cuff can pivot in relation to the strongback when the user pivots his lower leg for water skiing, and the mutually opposing edge portions of the recess being sufficiently resiliently flexible to yieldably bias the upper cuff to resume the normally upright position thereof when the user relaxes his leg and straightens it at the knee.

64. In a ski for use in water skiing, the combination of an elongated runner, and a high top boot that is upstanding on the runner and comprises an open topped shoe structure in which the user can insert the base of his foot, for mounting his foot on the ski, including means that operatively define a holster within which the user can engage the metatarsal portion of his foot when the base of it is supported on the runner, and a wall structure that is substantially rigidly upstanding on the runner about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent and straightened at the knee, but sufficiently independent of the strongback that when the user is supported on a body of water through the medium of the ski, with his feet in a pair of such boots, the cuff can pivot in conjunction with the user's lower leg, relative to the shoe structure, to any of the full range of positions in which the user may choose to pivot his lower leg for water skiing, including the low angle position needed when he squats or crouches for startup, the combination further comprising means for releasably detaining the upper cuff in the normally upright position thereof, means whereby the upper cuff can pivot in relation to the strongback, and means responsive to the pivotal action of the upper cuff, relative to the strongback, to yieldably bias the upper cuff to resume the normally upright position thereof when the user relaxes his lower leg and straightens it at the knee, the upper cuff being supported on the shoe structure so that the bottom portion of the same overlaps with the top portion of the strongback in the normally upright position of the upper cuff, one of the respective overlapping portions of the upper cuff and the strongback having a recess therein whereby the upper cuff can pivot in relation to the strongback when the user pivots his lower leg for water skiing, and the mutually opposing edge portions of the recess being sufficiently resiliently flexible to yieldably bias the upper cuff to resume the normally upright position thereof when the user relaxes his leg and straightens it at the knee.

65. In a high top boot with which a user can mount his foot on a water ski and undergo water skiing thereon, the combination of an open topped shoe structure in which the user can insert the base of his foot, including an elongated sole plate for use under the plantar surface of his foot, means that operatively define a holster within which the user can engage the metatarsal portion of his foot when the base of it is supported on the sole plate, and a wall structure that is substantially rigidly upstanding on the sole plate about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releaseably detaining the upper cuff in the normally upright position thereof, said upper cuff and holster having terminal edge portions thereof which oppose one another across the instep of the user's foot, and which are spaced apart from one another by a gap when the upper cuff is releaseably detained in the normally upright position thereof.

said gap and said releasable detention means having means therein whereby the upper cuff can pivot in conjunction with the user's lower leg, relative to the shoe structure, to any of the full range of positions into which the user may wish to pivot his lower leg for water skiing, including the low angle position of dorsiflexure needed when he squats or crouches for startup, means responsive to the pivotal action of the upper cuff, relative to the shoe structure, to yieldably bias the upper cuff to resume the normally upright position thereof when the user relaxes his lower leg and straightens it at the knee, the strongback being disposed to detain the upper cuff in the normally upright position thereof, means operatively interposed between the strongback and the upper cuff whereby the upper cuff is releasable from detention for pivoting in conjunction with the user's lower leg, relative to the strongback, when the user pivots his lower leg for water skiing, and the biasing means being responsive to the pivotal action of the upper cuff, to yieldably bias the upper cuff to resume the normally upright position thereof when the user relaxes his leg and straightens it at the knee.

66. In a high top boot with which a user can mount his foot on a water ski and undergo water skiing thereon, the combination of an open topped shoe structure in which the user can insert the base of his foot, including an elongated sole plate for use under the plantar surface of his foot, means that operatively define a holster within which the user can engage the metatarsal portion of his foot when the base of it is supported on the sole plate, and a wall structure that is substantially rigidly upstanding on the sole plate about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releaseably detaining the upper cuff in the normally upright position thereof, said upper cuff and holster having terminal edge portions thereof which oppose one another across the instep of the user's foot, and which are spaced apart from one another by a gap when the upper cuff is releaseably detained in the normally upright position thereof, said gap and said releasable detention means having means therein whereby the upper cuff can pivot in conjunction with the user's lower leg, relative to the shoe structure, to any of the full range of positions into which the user may wish to pivot his lower leg for water skiing, including the low angle position of dorsiflexure needed when he squats or crouches for startup, means responsive to the pivotal action of the upper cuff, relative to the shoe structure, to yieldably bias the upper cuff to resume the normally upright position thereof when the user relaxes his lower leg and straightens it at the knee, the upper cuff being supported on the shoe structure so that the bottom portion of the same overlaps with the top portion of the strongback in the normally upright position of the upper cuff, one of the respective overlapping portions of the upper cuff and the strongback having a recess therein whereby the upper cuff can pivot in relation to the strongback when the user pivots his lower leg for water skiing, and the mutually opposing edge portions of the recess being sufficiently resiliently flexible to yieldably bias the upper cuff to resume the normally upright position thereof when the user relaxes his leg and straightens it at the knee.

67. In a ski for use in water skiing, the combination of an elongated runner, and a high top boot that is upstanding on the runner and comprises an open topped shoe structure in which the user can insert the base of his foot, for mounting his foot on the ski, including means that operatively define a holster within which the user can engage the metatarsal portion of his foot when the base of it is supported on the runner, and a wall structure that is substantially rigidly upstanding on the runner about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releasably detaining the upper cuff in the normally upright position thereof, said upper cuff and holster having terminal edge portions thereof which oppose one another across the instep of the user's foot, and which are spaced apart from one another by a gap when the upper cuff is releasably detained in the normally upright position thereof, said gap and said releasable detention means having means therein whereby the upper cuff can pivot in conjunction with the user's lower leg, relative to the shoe structure, to any of the full range of positions into which the user may choose to pivot his lower leg for water skiing, including the low angle position of dorsiflexure needed when he squats or crouches for startup, means responsive to the pivotal action of the upper cuff, relative to the shoe structure, to yieldably bias the upper cuff to resume the normally upright position thereof when the user relaxes his lower leg and straightens it at the knee.

the strongback being disposed to detain the upper cuff in the normally upright position thereof, means operatively interposed between the strongback and the upper cuff whereby the upper cuff is releasable from detention for pivoting in conjunction with the user's lower leg, relative to the strongback, when the user pivots his lower leg for water skiing, and the biasing means being responsive to the pivotal action of the upper cuff, to yieldably bias the upper cuff to resume the normally upright position thereof when the user relaxes his leg and straightens it at the knee.

68. In a ski for use in water skiing, the combination of an elongated runner, and a high top boot that is upstanding on the runner and comprises an open topped shoe structure in which the user can insert the base of his foot, for mounting his foot on the ski, including means that operatively define a holster within which the user can engage the metatarsal portion of his foot when the base of it is supported on the runner, and a wall structure that is substantially rigidly upstanding on the runner about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releasably detaining the upper cuff in the normally upright position thereof, said upper cuff and holster having terminal edge portions thereof which oppose one another across the instep of the user's foot, and which are spaced apart from one another by a gap when the upper cuff is releasably detained in the normally upright position thereof, said gap and said releasable detention means having means therein whereby the upper cuff can pivot in conjunction with the user's lower leg, relative to the shoe structure, to any of the full range of positions into which the user may choose to pivot his lower leg for water skiing, including the low angle position of dorsiflexure needed when he squats or crouches for startup, means responsive to the pivotal action of the upper cuff, relative to the shoe structure, to yieldably bias the upper cuff to resume the normally upright position thereof when the user relaxes his lower leg and straightens it at the knee, the upper cuff being supported on the shoe structure so that the bottom portion of the same overlaps with the top portion of the strongback in the normally upright position of the upper cuff, one of the respective overlapping portions of the upper cuff and the strongback having a recess therein whereby the upper cuff can pivot in relation to the strongback when the user pivots his lower leg for water skiing, and the mutually opposing edge portions of the recess being sufficiently resiliently flexible to yieldably bias the upper cuff to resume the normally upright position thereof when the user relaxes his leg and straightens it at the knee.

69. In apparatus for water skiing, the combination of a water ski comprising an elongated runner having a pair of cleats on the dorsal side thereof which are spaced apart longitudinally of the runner, and a high top boot with which a user can mount his foot on the water ski, said boot comprising an open topped shoe structure in which the user can insert the base of his foot, including an elongated sole plate for use under the plantar surface of his foot, means that operatively define a holster within which the user can engage the metatarsal portion of his foot when the base of it is supported on the sole plate, and a wall structure that is substantially rigidly upstanding on the sole plate about the tarsal portion of the user's foot when the metatarsal portion of it is so engaged within the holster, said wall structure including a rear wall that upstands at the back of the shoe structure to a level above the ankle joint of the user's foot, to form a strongback for the achilles tendon of his foot, and a cuff-like superstructure which is engageable about the user's ankle when the base of his foot is inserted in the shoe structure, including a part annular upper cuff which is adapted to be removably secured about the user's lower leg above the ankle joint therein, and which is supported on the shoe structure at the top opening thereof, so as to have no more than limited capability to flex in relation to the shoe structure laterally thereof, said upper cuff being pivotally mounted on the wall structure to assume a normally upright position adjacent the strongback when the user's leg is relaxed and straightened at the knee, means for releasably detaining the upper cuff in the normally upright position thereof, said upper cuff and holster having terminal edge portions thereof which oppose one another across the instep of the user's foot, and which are spaced apart from one another by a gap when the upper cuff is releasably detained in the normally upright position thereof, said gap and said releasable detention means having means therein whereby the upper cuff can pivot in conjunction with the user's lower leg, relative to the shoe structure, to any of the full range of positions into which the user may choose to pivot his lower leg for water skiing, including the low angle position of dorsiflexure needed when he squats or crouches for startup, means responsive to the pivotal action of the upper cuff, relative to the shoe structure, to yieldable bias the upper cuff to resume the normally upright position thereof when the user relaxes his lower leg and straightens it at the knee, the upper cuff being supported on the shoe structure so that the bottom portion of the same overlaps with the top portion of the strongback in the normally upright position of the upper cuff, one of the respective overlapping portions of the upper cuff and the strongback having a recess therein whereby the upper cuff can pivot in relation to the strongback when the user pivots his lower leg for water skiing, and the mutually opposing edge portions of the recess being sufficiently resiliently flexible to yieldably bias the upper cuff to resume the normally upright position thereof when the user relaxes his leg and straightens it at the knee, and said sole plate being adapted to be positioned in the space between the cleats of the runner, there being means on the cleats for clamping the boot to the runner, and the clamping means being operable to release the boot when a predetermined shear force is generated between the ski and the boot transverse thereof.

* * * * *